US005524524A

United States Patent [19]

Richards et al.

[11] Patent Number: 5,524,524

[45] Date of Patent: Jun. 11, 1996

[54] INTEGRATED SPACING AND ORIENTATION CONTROL SYSTEM

[75] Inventors: Les H. Richards, Temple; David J. Schorr, Austin; Mark J. Kelley, Dripping Springs; Philip L. McDuffie; Edward R. Coleman, both of Austin, all of Tex.

[73] Assignee: Tracor Aerospace, Inc., Austin, Tex.

[21] Appl. No.: 328,255

[22] Filed: Oct. 24, 1994

[51] Int. Cl.[6] ..... F42B 22/24

[52] U.S. Cl. ..... 89/1.13; 89/1.11; 102/310; 102/403

[58] Field of Search ..... 89/1.13, 1.11, 89/1.1, 1.15; 102/402, 403, 302, 310; 244/570, 239; 206/485

[56] References Cited

U.S. PATENT DOCUMENTS

| | | | |
|---|---|---|---|
| 2,433,875 | 1/1948 | Walker et al. | 102/403 |
| 2,455,354 | 12/1948 | Bisch | 102/22 |
| 2,509,205 | 5/1950 | Bisch | 102/403 |
| 2,828,008 | 3/1958 | Fryburger | 206/405 |
| 2,842,263 | 7/1958 | Giraudet | 206/485 |
| 2,881,914 | 4/1959 | Woeber et al. | 206/485 |
| 3,183,835 | 5/1965 | Bisch | 102/19 |
| 3,242,862 | 3/1966 | Stegbeck et al. | 102/22 |
| 3,268,016 | 8/1966 | Bell | 102/310 |
| 3,638,569 | 2/1972 | Thomanek | 102/22 |
| 3,724,319 | 4/1973 | Zabelka et al. | 89/1 M |
| 3,965,993 | 6/1976 | Lavigne et al. | 102/310 |
| 4,051,763 | 10/1977 | Thomanek | 102/403 |
| 4,381,057 | 4/1983 | Carver | 206/485 |
| 4,583,641 | 4/1986 | Gelzer | 206/485 |
| 4,768,417 | 9/1988 | Wright | 89/1.11 |
| 4,776,255 | 10/1988 | Smith | 89/1.13 |
| 4,823,672 | 4/1989 | Eidelman | 89/1.13 |
| 4,967,636 | 11/1990 | Murray et al. | 89/1.13 |
| 5,063,822 | 11/1991 | Lopez de Cardenas | 89/1.15 |
| 5,099,747 | 3/1992 | Smith | 89/1.13 |
| 5,417,139 | 5/1995 | Boggs et al. | 89/1.13 |

FOREIGN PATENT DOCUMENTS

| | | | |
|---|---|---|---|
| 40835 | 12/1981 | European Pat. Off. | 206/485 |
| 4024112 | 2/1992 | Germany | 206/485 |
| 452143 | 8/1936 | United Kingdom | 206/485 |
| 2101094 | 1/1988 | United Kingdom | 206/485 |

OTHER PUBLICATIONS

Technical Reports on "Improved Dispersed Explosive (IDX)," Distributed Explosive Mine Neutralization System (DEMNS), and Standoff Minefield Breacher (SMB), name and date of publication unknown.

Published description of Mineclearing Line Charge M58/M59 (MICLIC), name and date of publication unknown.

Published description of Giant Viper Anti-tank Mineclearing Equipment, name and date of publication unknown.

Brochure describing Titan shaped charge penetrator, name and date of publication unknown.

"Best Technical Approach Analysis (BTA) for the Standoff Minefield Breaching Capability (SMBC)," Final Report prepared for U.S. Army Belvoir Research, Development and Engineering Center, Nov. 22, 1993.

*Primary Examiner*—Charles T. Jordan
*Assistant Examiner*—Theresa M. Wesson
*Attorney, Agent, or Firm*—Arnold, White & Durkee

[57] ABSTRACT

An integrated spacing and orientation control system is provided for carrying an array of objects and maintaining a predetermined orientation of the objects and a predetermined spacing between objects. In a presently preferred application, the spacing and orientation system carries an array of anti-mine munitions for clearing a path through a minefield. The invention deploys the anti-mine munitions in a downwardly pointed orientation with proper spacing between munitions, even when the array of munitions is deployed using rocket motors.

13 Claims, 16 Drawing Sheets

INTEGRATED SPACING AND ORIENTATION CONTROL SYSTEM

BACKGROUND OF THE INVENTION

This invention provides a structure for providing spacing and orientaion control for a plurality of objects intended to be arrayed over a selected area. A particularly well-suited application for the present invention is to provide spacing and orientation control for a plurality of anti-mine munitions to be arrayed over a selected area of a minefield, where it is imperative that a majority of the munitions be properly spaced and oriented downwardly.

Many different techniques have been used in the past for clearing safe pathways across minefields. Most of these methods involved either physically detonating or removing mines or creating an overpressure pulse using distributed explosives to detonate or destroy mines along a selected route. For example, U.S. Pat. No. 3,242,862 discloses a method and apparatus for sweeping mine fields comprising a string of explosive charges connected to a carrier including a fuse. The string of charges is placed over the minefield, for example, using a rocket to carry the leading end over the minefield while the trailing end is attached to the box that the system is stored in to keep the system from traveling too far. The explosives are then detonated to detonate, destroy, or remove mines that are located proximate the string of charges.

The "Giant Viper" approach (British) provides a hose filled with plastic explosive that is deployed over a minefield by a cluster of rocket motors and automatically detonated after the hose has landed. The "Giant Viper" system has been tested to clear about 90% of anti-tank mines within its effective area, provided they were not blast-proofed or multi-fuzed.

The IDX ("improved dispersed explosive") system explosively disseminates a cloud explosive material and then detonates it, which provides a distributed blast that clears mines in the area by actuation of fuses and sympathetic detonation of the main charges in surface laid mines.

The "MICLIC" Mine Clearing Line Charge is used by the United States military. MICLIC is a linear charge containing C4 explosive distributed in unit charges assembled around a core of nylon rope and detonating cord. The MICLIC is deployed by a rocket motor that pulls the linear charge out of a storage container and over the target area. An arresting cable is used to restrict the travel of the system, and it falls into place over the minefield. The charge is then detonated to clear a path about 12 meters wide and 100 meters long.

Other prior art mineclearing techniques include physically locating and neutralizing mines, for example with rollers, plows or by hand. This is obviously a hazardous activity that is to be avoided if possible. Mine detonator technology has advanced to the point that modern sophisticated detonators and hardened mine structures can withstand the present explosive overpressure methods, by requiring stimulus other than a single pressure pulse to activate the detonator. In particular, modern detonators and mine fuses can be made blast resistant, and can be designed to detonate the mine charge based on magnetic, seismic, acoustic, radar or other stimulus.

In recent years, shaped explosive charges that create penetrating jets have been employed in prototypes to kill mines by directly piercing the mines. The penetrating jets can penetrate through many inches of soil and retain enough energy to destroy a buried mine. A mine that is pierced by such a jet is detonated by the shock and heat of the jet, or the detonator of the mine may be destroyed if it is penetrated rather than the main charge.

Unlike prior methods and apparatuses to breach minefields, penetrating shaped charge munitions provide highly directional penetrating jets, which are intended to be pointed directly downward into the ground. Using statistical methods, based on the known sizes of the mines that are likely to be present in a given minefield, spaced arrays comprising thousands of penetrating munitions may be designed with an optimum spacing between munitions to achieve a desired effectiveness. The design methods assume that the munitions will be deployed pointing downward. If the orientation of the munitions is not adequately controlled, then mines may be missed, and the designed effectiveness of the system will not be achieved (with potential disastrous consequences).

Early efforts to provide deployment systems for penetrating munitions employed a rope net with the munitions suspended at the intersections of longitudinal and lateral ropes, in such a way that tension in the ropes caused the munitions to be oriented normal to the plane of the net. The net was deployed from a safe standoff distance using rocket motors and drag chutes to provide longitudinal tension, and lateral expanding spars to spread and tension the net laterally. In practice, the net could not be adequately tensioned to assure that the munitions were properly oriented after deployment, in large part because the net hit the ground with forward momentum, rather than falling flat on the ground or to maintain the munitions in an upright position. The net had no stiffness or inherent tendency to lay flat on the ground. After hitting the ground, the tension in the net was lost and there was no righting moment acting on the individual munitions. Furthermore, it proved difficult to expand the net to its full size and to provide adequate tensioning while airborne, resulting in bunching of the net and the munitions carried thereby, and consequently reducing the size of the area that was cleared by the system, as well as the effectiveness of the munitions within that area.

Furthermore, a jet can be deflected when it strikes the ground or an object, such as a mine, off-normal. This means that munition pointing errors not only lower the probability of hitting a mine, but they reduce the effectiveness of the munitions even when a mine is contacted by a jet.

The use of penetrating munitions is considered to be a promising technique for destroying mines, but a method is needed for deploying such munitions over a large area (150 meters long by 5 meters wide or larger) from a safe standoff distance (e.g. 50–75 meters) that will assure proper orientation and spacing of the munitions, so that the designed optimum effectiveness of the munition array can be achieved on the battlefield.

SUMMARY OF THE INVENTION

Integrated spacing and orientation control systems according to the present invention provides spacing and orientation control for the munitions that are used in a penetrating munition array. This provides benefits including 1) maximizing effectiveness for a given munition quantity; 2) maintaining the munition orientation on the ground, suspended in the air, and underwater; and 3) supporting the use of optimum munition grid arrangements and spacing. The system according to the invention also provides a flexible explosive array which lends itself to high density packaging and reliable deployment. The detonation medium used to detonate each of the penetrating charges, which may be, for example, detonating cord or tape, may be incorporated into the structure of the spacing and orientation control system to prevent entanglement of loose detonation lines. The detonating medium may be arranged to interconnect the munitions in a net-like fashion to provide cross propagation of the detonating energy and redundancy of detonating paths. The present invention provides reliable orientation control while fully supporting and protecting the munition with a high strength, lightweight structure.

In preferred embodiments, the present invention provides apparatus and methods for breaching a mine field from a safe standoff distance outside of the lethal range of the mines and submunitions being neutralized. The invention may be employed in a minefield breaching system for neutralizing surface laid and buried mines regardless of fusing, and it employs an explosive array concept which relies on a rocket deployed explosive neutralization system. Other deployment methods may also be used to spread a system according to this invention over a minefield. In preferred embodiments, this explosive neutralization system is comprised of a flexible structure supporting small shape-charge anti-mine munitions designed to neutralize the mines in a selected area. The structure is coupled to each munition at two points, which may be the top of the munition and the bottom of the munition, to provide a turning moment that tends to keep the munition oriented upright when the system is deployed. When the explosive neutralization system is deployed, it expands out over the area to be cleared, and the spacing and orientation control structure according to the present invention ensures that the munitions are properly spaced and oriented, even if the array hits the ground with some amount of forward or lateral momentum.

Integrated spacing and orientation control systems, according to this invention, may be formed from strapping material that is connected to the top and bottom of each munition and constructed as shown in FIG. 2 to form a stable three dimensional structure that orients the munitions substantially normal to the plane of the system. Alternatively, a spacing and orientation control system according to this invention may comprise two sheets of material, an upper sheet and a lower sheet. The munitions may be positioned between the sheets, with the upper sheet coupled to the top of the munitions and the lower sheet coupled to the bottom of the munitions. The two sheets may then be joined together between the munitions, as by stitching, in order to form a three-dimensional structure that properly orients the munitions, as shown in FIG. 8. Further embodiments are shown in FIG. 10, 14 and FIG. 15 wherein groups of munitions are connected together by rigid structures that hold the munitions normal to the planes of the structures, such that the munitions are directed downward into the ground when the structures containing the munitions are placed flat on the ground. A plurality of such structures may be connected by rope nets or other means to form a full scale array of mine-clearing munitions that can be deployed as described below.

A preferred embodiment of a beneficial use of the present invention is illustrated in FIG. 1. A mine-threat area may be identified which is typically a transportation route that is desired to be cleared of active mines. The mine-threat area may be a flat piece of ground, but typically it includes such things as craters, water channels, shrubs, rocks and other obstacles which can interfere with some forms of mine clearing operations. The mine clearing operation illustrated in FIG. 1 comprises placement of an explosive array over the mine-threat area and detonating the munitions contained in the explosive array so as to destroy or neutralize mines that may be present in the mine-threat area. The explosive array may be deployed over the mine-threat area by rocket motors as shown in the illustrated embodiment, which pull the explosive array away from the launching platform. Drag chutes at the aft end of the array may be employed in order to control placement of the explosive array over the mine-threat area. In preferred embodiments, the launching platform is kept outside of the lethal range of the explosives that may be located in the minethreat area and the explosives contained in the explosive array. In preferred embodiments, the platform is a trailer containing the explosive array, the rocket motors, and the aerodynamic drag bodies which can be pulled by a motorized vehicle such as a tank, a truck, or a personnel carrier. Alternatively, the system can be mounted on board ship for use in clearing a mine-threat area near shore or beach environment. In preferred embodiments, telescoping expander tubes or spars are coupled to the explosive array to stretch it to its lateral extent during deployment.

The spacing and orientation control structures described herein are suitable for use with articles other than anti-mine munitions. Such structures used for other applications are considered to be within the scope of the present invention.

BRIEF DESCRIPTION OF THE DRAWINGS

So that the manner in which the herein described advantages and features of the present invention, as well as others which will become apparent, are attained and can be understood in detail, more particular description of the invention summarized above may be had by reference to the embodiment thereof which is illustrated in the appended drawings, which drawings form a part of this specification.

It is to be noted, however, that the appended drawings illustrate only exemplary embodiments of the invention and are therefore not to be considered limiting of its scope, for the invention may admit to other equally effective embodiments.

DETAILED DESCRIPTION OF THE PREFERRED EMBODIMENTS

In a most general aspect, the invention comprises structures for providing spacing and orientation control for an array of small objects. In presently preferred embodiments, the invention is designed for providing spacing and orientation control for an array of munitions for neutralizing land mines. A minefield breaching system utilizing the present invention provides a structure for dispersing downwardly oriented penetrating munitions over a portion of a minefield. The munitions are detonated so as to destroy or otherwise neutralize mines that are located in the portion of the minefield covered by the system. The penetrating munitions are spaced so that they are statistically likely to neutralize an optimal percentage of the mines that are present in the portion of the minefield to be cleared.

While the invention may be beneficially used for other applications, such as deployment of distributed sensors, antenna elements, or other types of explosive elements, most of the following description describes the invention in terms of the mine clearing application for which the invention was initially developed.

Figure 6:
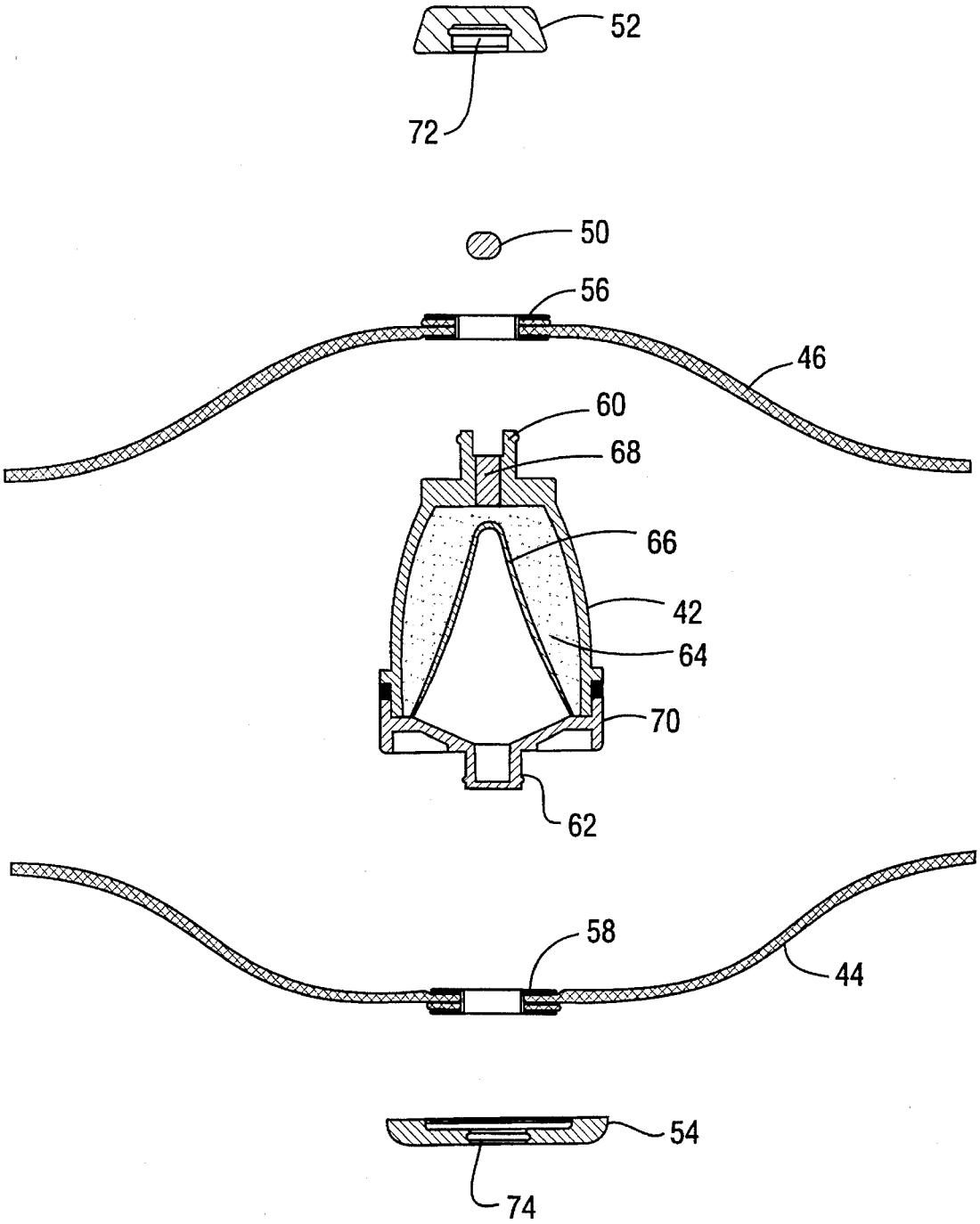
FIG. 6 is a cross-sectional illustration of the exploded view of FIG. 5.

In preferred embodiments, each anti-mine munition may be a small plastic-encased shaped charge with a metallic liner which produces an explosively formed penetrating jet when detonated. The preferred shaped charge concept incorporates innovative design features for producing characteristics in a jet that are sufficient to cause mine neutralizing events extending between hydrostatic rupture to higher order detonation of the main charge. Other characteristics of the jet (primarily velocity length and mass) provides means for effective performance over a wide range of standoffs and mine burial depth (i.e., overburden). Each anti-mine munition explosively projects a small jet of metal downward into the mine field. When the jet strikes a mine it transfers sufficient kinetic energy to cause detonation or deflagration of the main explosive charge. It is effective against surface and buried mines regardless of fusing, because it directly destroys or damages the main charge. The anti-mine munition configuration developed and demonstrated specifically for the present invention is shown in FIG. 6.

An array of penetrating munitions carried by a spacing and orientation control system according to this invention may be deployed using rockets to pull the leading edge of the array out of a container and across a minefield. Laterally expanding struts may be employed to spread the array to its full lateral width. Drag chutes or tethers may be used to retain the trailing edge of the array in a desired position. Alternately, the array may be pulled out of a package and spread across a minefield by a machine such as a bulldozer, a helicopter, or a robot, or it may even be deployed by a long range rocket, missile, drone or aircraft. The integrated spacing and orientation control systems of this invention are not, however, to be limited to particular methods of deployment of the system over a minefield.

FIG. 1A, FIG. 1B, FIG. 1C, and FIG. 1D illustrate a typical exemplary deployment sequence for an explosive array using the spacing and orientation control system according to this invention. In preferred embodiments, a system according to the present invention may be packaged in a trailer system which can be towed. Host vehicle 38 will tow the trailer into the proper horizontal (azimuth) alignment to a position roughly 50–75 meters from the near edge of the mine field. The launchers will be elevated and the rocket motor 24 will deploy the explosive neutralization system over the mine field. The required stand-off (50–75 meters) and the longitudinal explosive neutralization system expansion (e.g., 150–200 meters) is provided by the combination of the forward thrust of the tow motors and the arresting aerodynamic forces produced by the drag chutes. The in-flight lateral expansion (e.g., 5–8 meters) of the explosive neutralization system according to the present invention is provided by the initiation of the lateral expansion devices. The longitudinal and lateral expansion of the explosive neutralization system is required to spread the explosive array over the required breach lane. Drag chutes attached to the rear of the explosive neutralization system may be used to slow the trajectory until the open array settles over the mine field. After the array has settled, the detonation cord may be initiated which in turn detonates all of the anti-mine munitions to clear a lane through the mine field.

Figure 1:
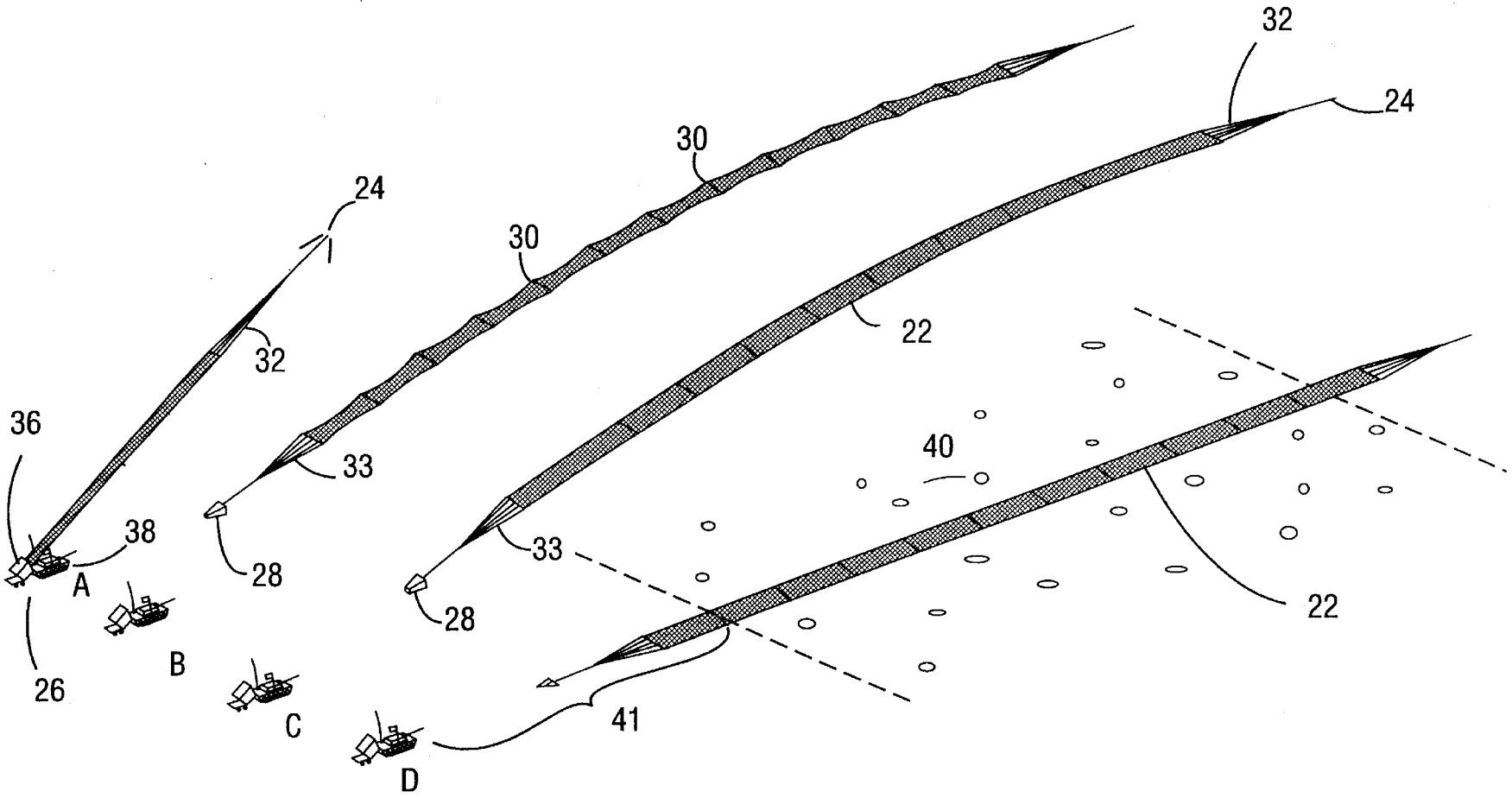
FIG. 1A, FIG. 1B, FIG. 1C and FIG. 1D illustrate four progressive steps involved in an exemplary method of deployment of an explosive array over a portion of a minefield.

In FIG. 1A platform 26 comprises host vehicle 38 and trailer mounted container 36. Tow rocket 24 is shown pulling explosive array 22 out of container 36. Tow rocket 24 is connected to explosive array 22 by bridle assembly 32.

In FIG. 1B, explosive array 22 can be seen completely separated from container 36. Drag chute 28 and aft bridle assembly 33 provide drag at the back end of explosive array 22 to ensure that it stays completely stretched out as it is pulled over mine field 40. In FIG. 1B, lateral expansion devices 30 can be seen as having expanded somewhat from their shortened configuration as illustrated in FIG. 1A.

FIG. 1C illustrates full expansion of explosive array 22. Longitudinal expansion is caused by the action of tow rocket 24 at the front end of the array and drag chute 28 at the back end of the array. Lateral expansion has been effected by the operation of lateral expansion devices 30. Lateral expansion devices 30 may be utilized with any of the embodiments described herein. They are laterally disposed axially extendable beams that extend after launch of the spacing and orientation control system to stretch the array to its full lateral width before it hits the ground. The lateral expansion devices 30 may comprise telescoping tubes, and they may expand by inflation, explosive means, mechanical means or otherwise. In FIG. 1C, the array is shown in ballistic flight prior to landing over the mine field.

FIG. 1D explosive array 22 having settled down on the mine field. Note that the platform 26 is located at a safe standoff distance 41 away from the edge of mine field 40 and from the trailing edge of explosive array 22. As soon as the explosive array is laid over mine field 40, it can be detonated in order to clear a path through the mine field for transportation of personnel and equipment.

In some embodiments, as described below, array 22 is designed to be compressible and flexible, such that the munitions can be moved into a closely spaced arrangement and the compressed array may be folded into container 36. Packing material, such as paper or film, may be used to separate layers of the explosive array 22 as it is folded into container 36 for storage and transport. That packing material prevents entanglement or other fouling of the array that might prevent proper deployment.

A typical deployment method for the spacing and orientation control system of this invention has been described so that the advantages of the invention can be understood and appreciated. The present invention is not limited to any particular deployment method or system, and it is not limited to mine-clearing applications.

Figure 2:
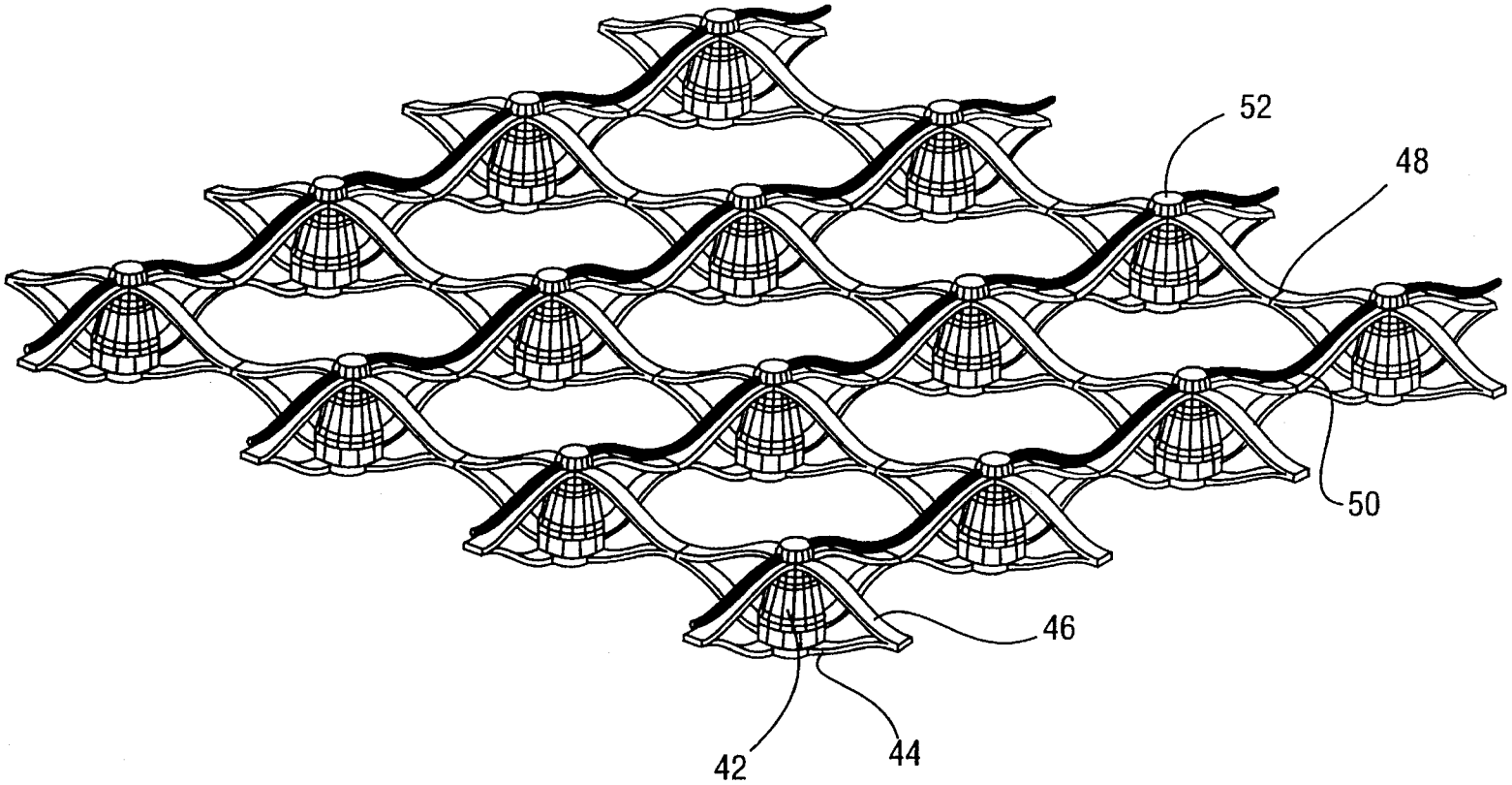
FIG. 2 is a perspective view of a portion of a penetrating munition array according to a preferred embodiment of the present invention.

FIG. 2 illustrates a preferred embodiment of an integrated spacing and orientation control system according to the present invention. In order to provide a plurality of penetrating munition assemblies 42 regularly spaced from one another and pointing downward, said assemblies are mounted in a spacing and orientation control system comprising lower strapping 44 and upper strapping 46. A preferred strapping material is a woven tubular polyester material which can be flattened into a ribbon-like strapping configuration. A suitable material for this purpose is Dynamic Stress Webbing (DSW), a self-fitting oversleeve that is commercially available from BentlyHarris, Lionville, Pa. DSW is braided from high tensile strength polyester and nylon filaments. The loose weave of DSW makes it resilient and easy to handle, yet once it is fabricated into the spacing and orientation control system of this invention it provides sufficient stiffness and spring rate to lay in a flat panel and to exert righting moments on the munitions carried by the system. Other materials may be selected for this application as a matter of design choice. The strapping is preferably flexible enough to be compressed for storage and transport, yet adequately stiff and spring-like to return to its elonged condition during deployment of the explosive array. The strapping 44, 46 is coupled to both the top end and bottom end of munition assembly 42 so as to control the substantially vertical orientation of each munition assembly 42. Lower strapping 44 is coupled to upper strapping 46 between munition assemblies 42 by strapping fasteners 48, to form a triangulated structure that operates to properly orient and stabilize the munition assemblies even if the array is not optimally tensioned. The strapping fasteners may comprise stitching, stapling, adhesives, or other means suitable for the purpose. In order to trigger each munition assembly 42 at the desired time, detonating cord 50 is connected to each munition assembly 42. In the illustrated embodiment, each munition assembly 42 comprises a top cap 52 which secures upper strapping 46 and detonating cord 50 to the top end of munition assembly 42.

The integrated spacing and orientation control system illustrated in FIG. 2, as well as other preferred embodiments, exhibits a degree of stiffness in the plane of the array, which tends to prevent buckling or bunching of the array during flight and upon landing. The at-rest configuration of these systems is similar to the desired deployment configuration, thus causing the system structure itself to aid in expansion of the system during deployment. The righting moment imposed on the munitions by the structure maintains the munitions aimed in a direction substantially normal to the plane of the array, so that at landing the array is expanded into a generally planar configuration and the munitions are directed downward into the ground. Even if localized portions of the array are not fully expanded when the array comes to rest, the compressive spring rate of the preferred strapping material compensates to maintain the munitions in the desired orientation.

In the embodiment illustrated in FIG. 2, munition assemblies 42 are laid out in a generally square pattern. Alternative arrangements are possible, and a triangular arrangement is believed to be desirable for optimizing the effectiveness of a given number of munitions.

Figure 3:
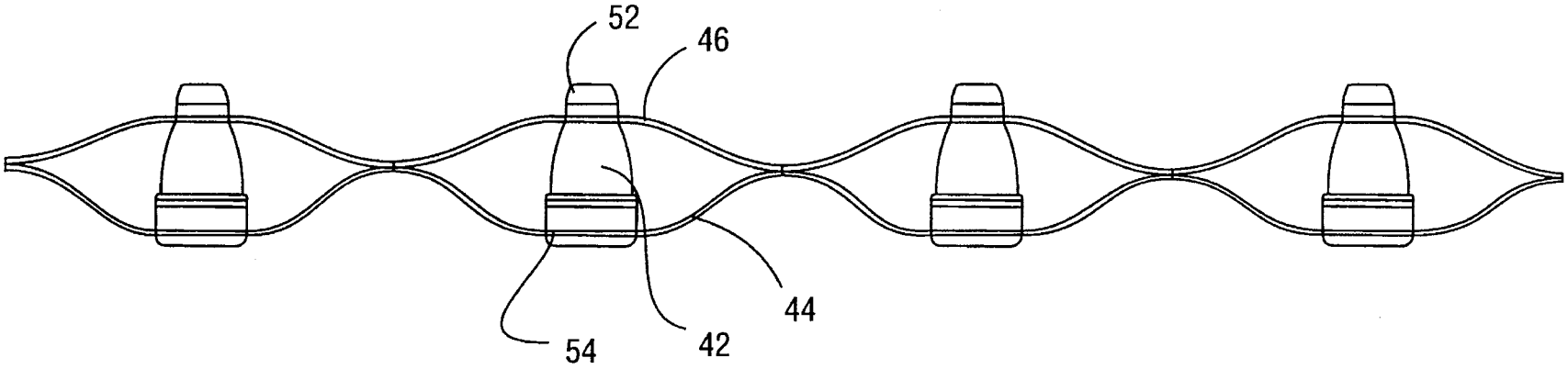
FIG. 3 is an elevation view of a portion of a penetrating munition array according to a preferred embodiment of the present invention.

FIG. 3 illustrates a cross section of the embodiment shown in FIG. 2. The upper end of munition assembly 42 is coupled to upper strapping 46, which is retained by top cap 52. Similarly, the bottom end of munition assembly 42 is coupled to lower strapping 44 are retained by bottom cap 54. Upper strapping 46 and lower strapping 44 are coupled to one another between munition assemblies 42 by strapping fasteners 48. This arrangement provides a triangulated structure which affectively stabilizes the munition assemblies 42 in a downwardly pointing direction. The structure could be modified to orient the munitions in a different manner if desired.

Figure 4:
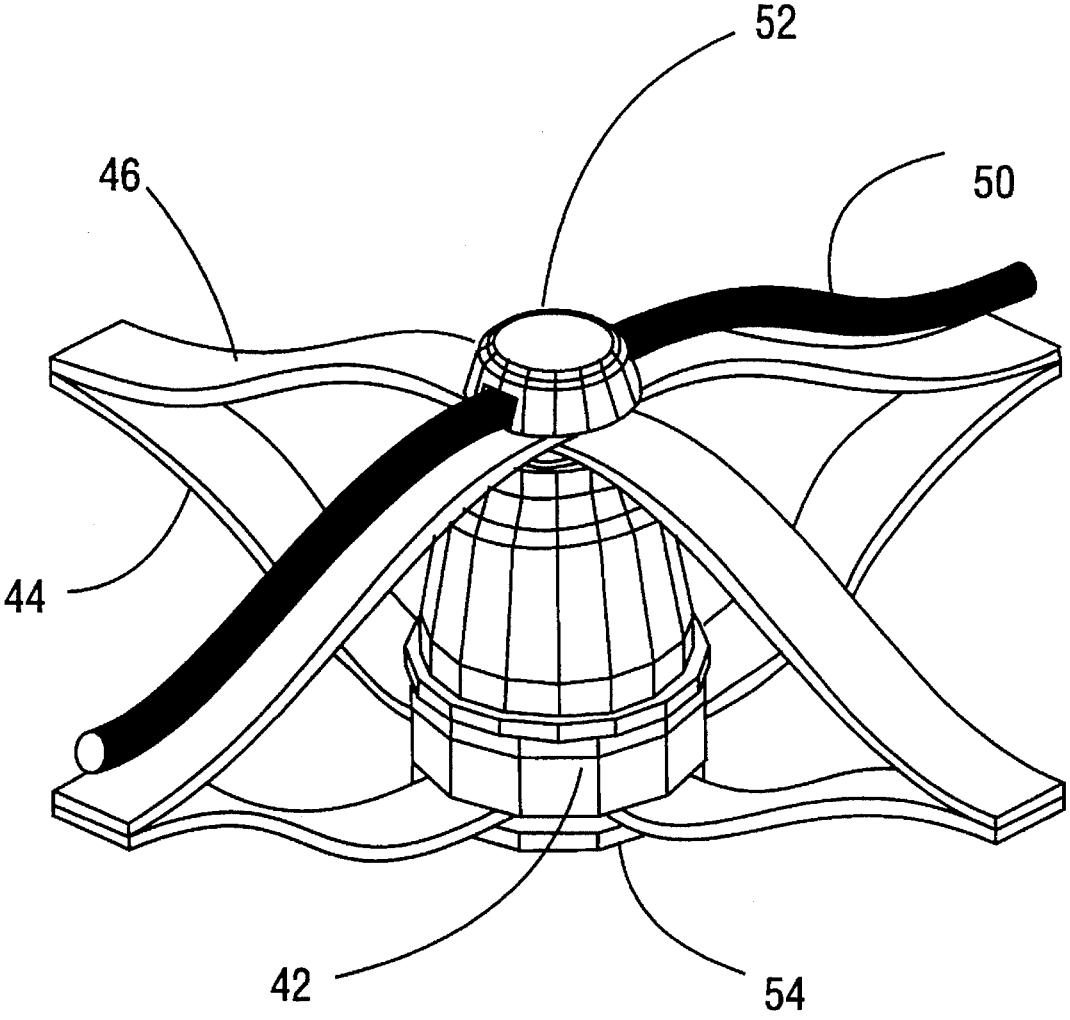
FIG. 4 is a perspective view of a single penetrating munition and the related portions of a preferred spacing and orientation control structure.
Figure 5:
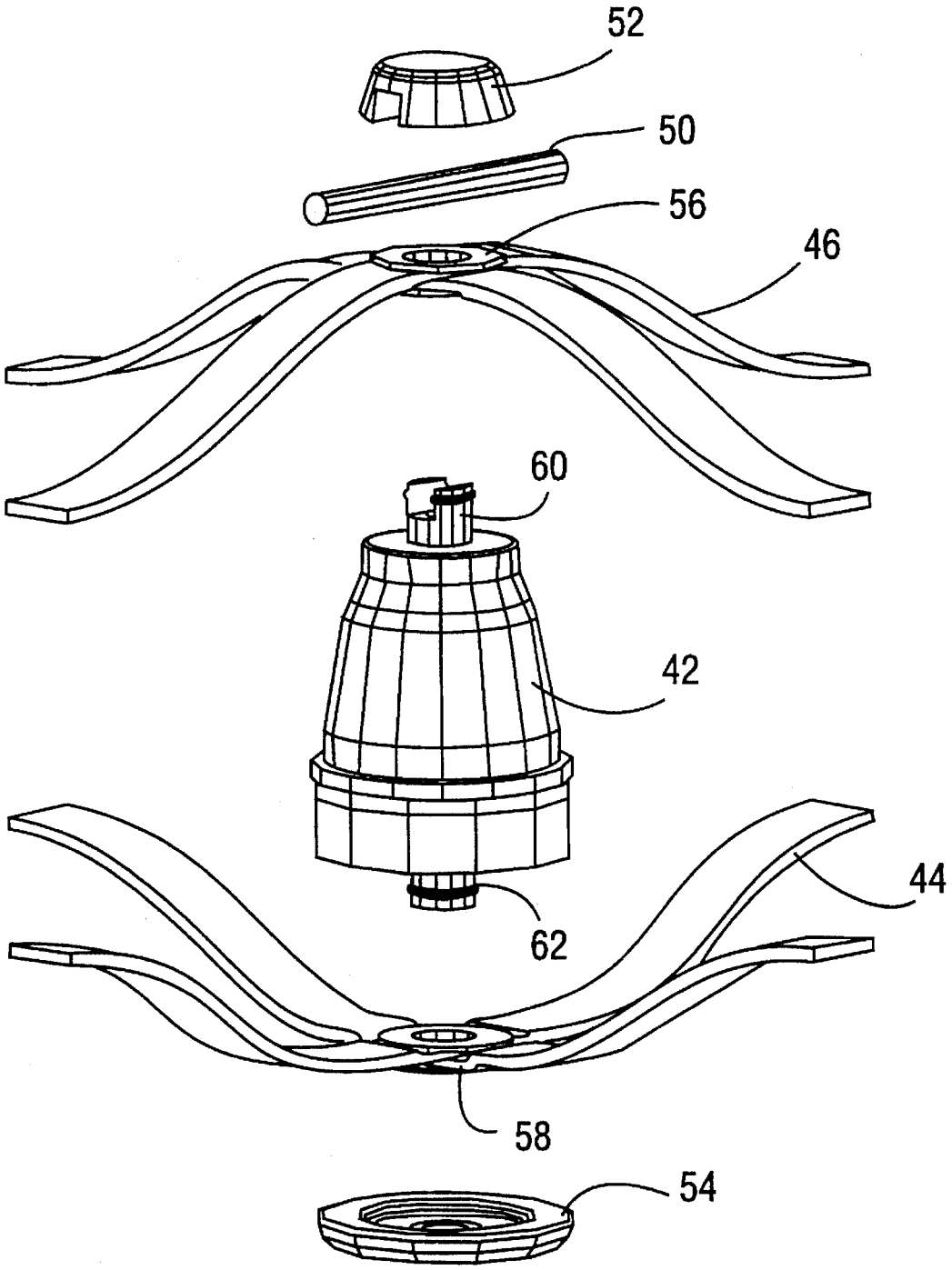
FIG. 5 is an exploded illustration of the subject matter of FIG. 4.

FIG. 4 shows a munition assembly 42 in the associated nearby structural elements according to the present invention. Upper strapping elements 46 cross at the location of the top of munition assembly 42 and are retained at that location by top cap 52. Detonation cord 50 also is retained on top of munition assembly 42 by top cap 52. Lower strapping 44 also crosses at the location of the bottom of munition assembly 42 and is retained in place at that point by bottom cap 54. FIG. 5 shows an exploded diagram of the components that are illustrated in FIG. 4. The point at which the longitudinal elements of upper strapping 46 cross the lateral elements of said strapping may be reinforced by upper grommet 56. Likewise, the lower strapping may be reinforced by lower grommet 58 at crossover points. Munition assembly 42 may have an upper snap-on projection 60 extending from the top thereof which is designed to pass through upper grommet 56, to engage detonation cord 50 and to receive top cap 52 in a snap-on fashion. Likewise, a lower snap-on projection 62 may be provided projecting from the bottom of munition assembly 42. Lower snap-on projection 62 may pass through lower grommet 58 and be received by bottom cap 54 in a snap-on fashion.

FIG. 6 a cross section of the subject matter of FIG. 5. Munition assembly 42 includes explosive 64 and metallic liner 66, which when detonated operates to form a penetrating jet that is directed downward into the earth. A centering charge 68 may be provided to couple explosive 64 to the channel in upper snap-on projection 60 that receives detonation cord 50. In this and in other embodiments of the present invention, the detonating cord 50 may be integrally formed with the structural members of the system, for example by laminating detonating medium to the structural members.

Standoff collar 70 may be provided to provide spacing between the bottom of the explosive 64 and metallic liner 66 and the ground. An optimum standoff distance can be designed into the design of munition assembly 42. Bottom cap 54 and standoff collar 70 are designed so as to avoid undesirable obstruction or modification of the jet formed by the munition. Top cap 52 and bottom cap 54 each have a snap-on receptacle 72, 74 constructed therein for receipt of the snap-on projections located at the upper and lower ends of munition assemblies 42.

Shaped charged penetrators for use in neutralizing land mines can be obtained from Titan Corporation, Titan Research and Technology Division, 5117 Johnson Drive, Pleasanton, Calif.

Figure 7:
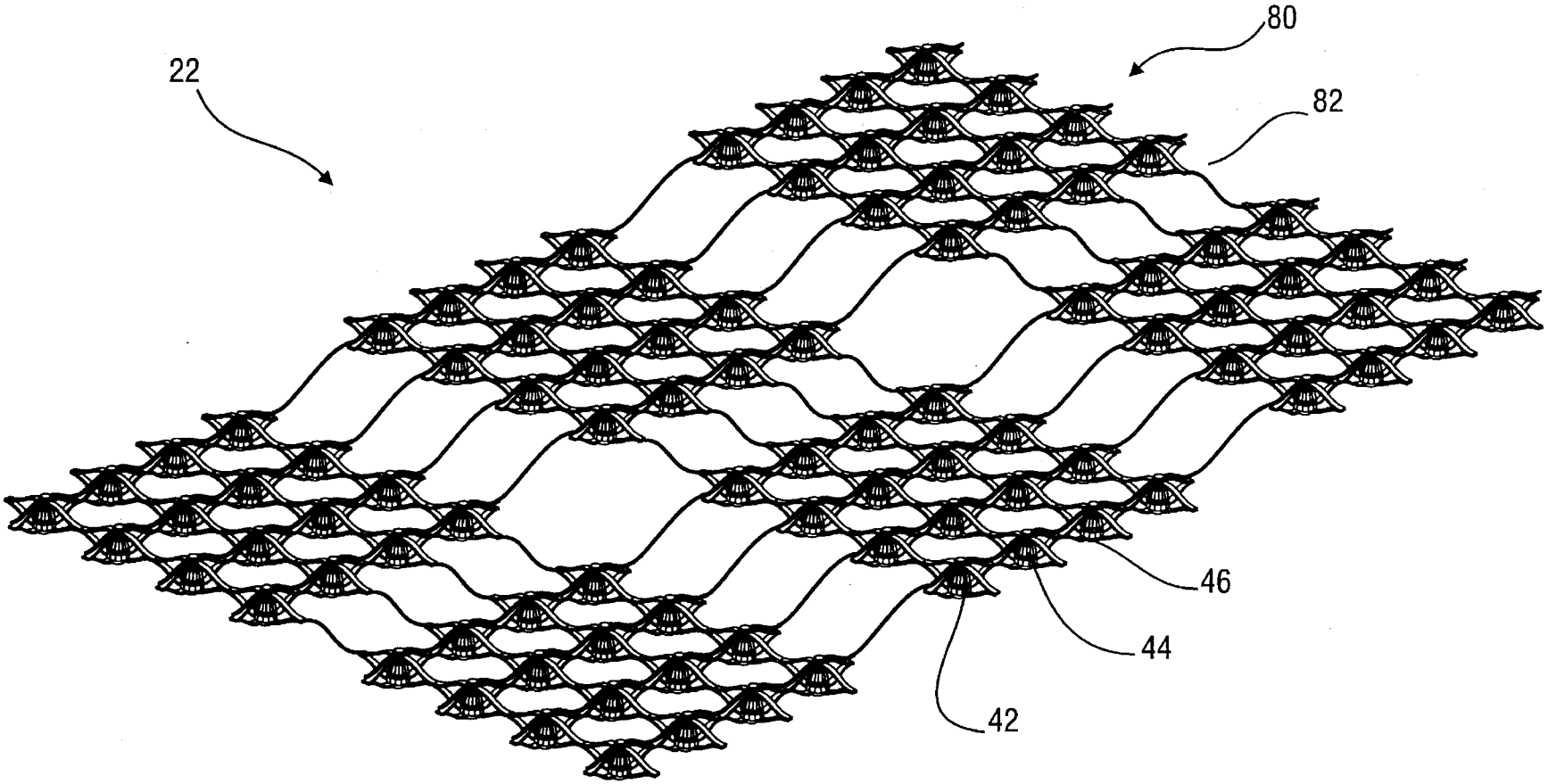
FIG. 7 illustrates a portion of an array of penetrating munitions comprising a plurality of panels connected by flexible elements.

FIG. 7 illustrates how an explosive array 22 may be constructed comprising a plurality of independent panels 80 as shown in FIG. 2. The munition assemblies 42 making up each panel 80 may be coupled to one another in a triangulated fashion using a relatively stiff material to provide spacing and orientation control. Each panel 80 may then be coupled to adjacent panels by connecting lines 82. Connecting lines 82 may be relatively flexible material that permits each panel 80 to come to rest on the mine field independently of the adjacent panels. This arrangement will tend to isolate each panel from obstructions that may have been encountered by adjacent panels, and will permit an optimum number of panels and munitions assemblies to lie on the ground in the proper orientation. Note that the illustration of FIG. 7 shows exaggerated distances between the munition assemblies 42 in adjacent panels 80. In preferred embodiments, the spacing between munitions and adjacent panels should not be much greater than that of the munitions within each panel. Panels that are flexibly connected together in this way may be of any desired size, from several inches to several meters on a side. The array structure may also be formed as discrete panels that are connected to other structural elements, such as lateral expansion devices, as well as to one another.

FIG. 7 illustrates the concept of providing independent panels connected by relatively flexible connecting lines 82. This concept may be implemented with panels made up of munitions connected by strapping, as shown in FIG. 7, or by panels made in alternative ways as described below. Detonating cords can be run between adjacent panels 80 in conjunction with connecting lines 82.

Figure 8:
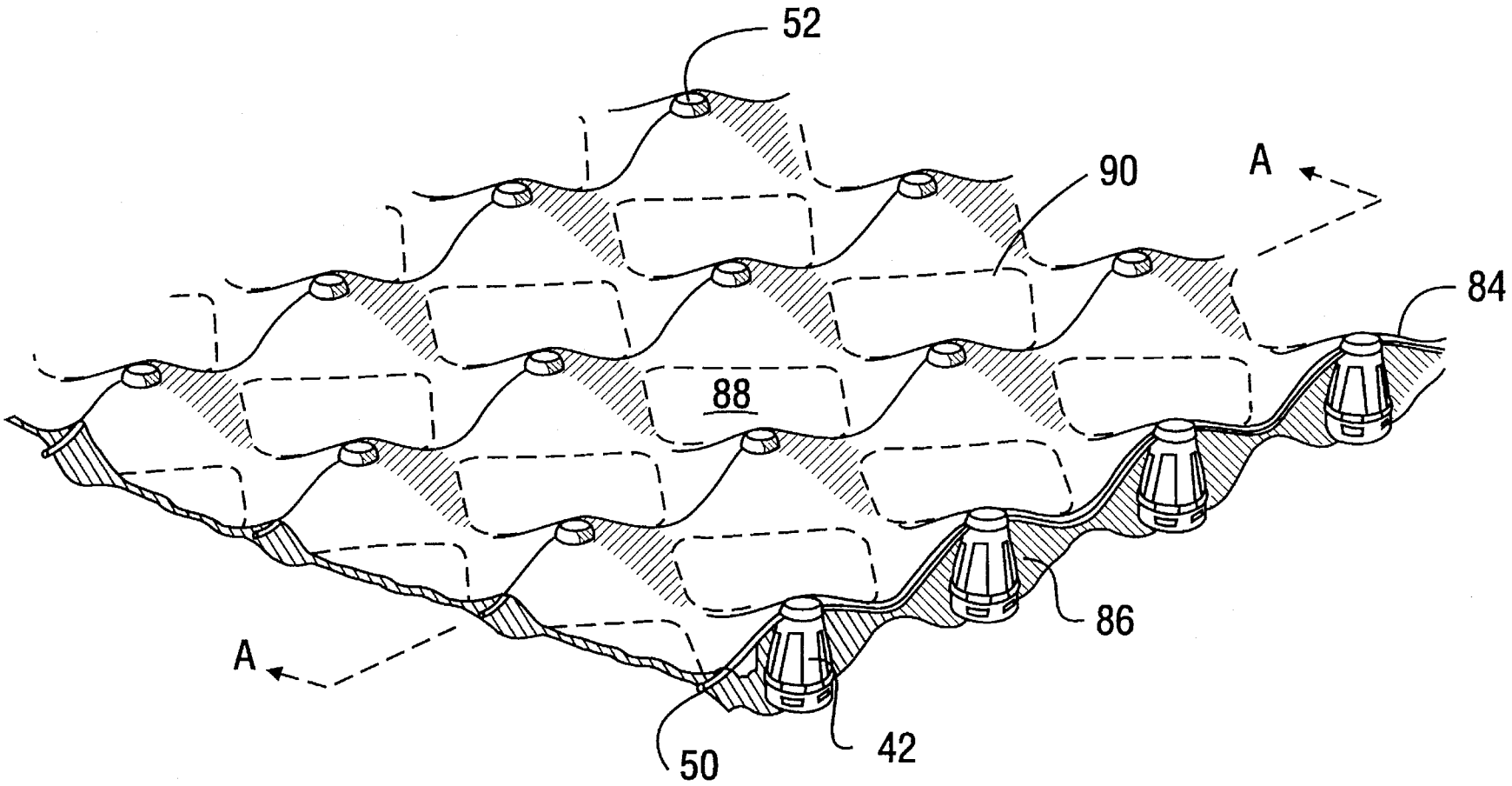
FIG. 8 is a perspective view of an alternative embodiment of the present invention comprising a plurality of penetrating munitions carried by a spacing and orientation control structure made of fabric or film sheeting.
Figure 9:
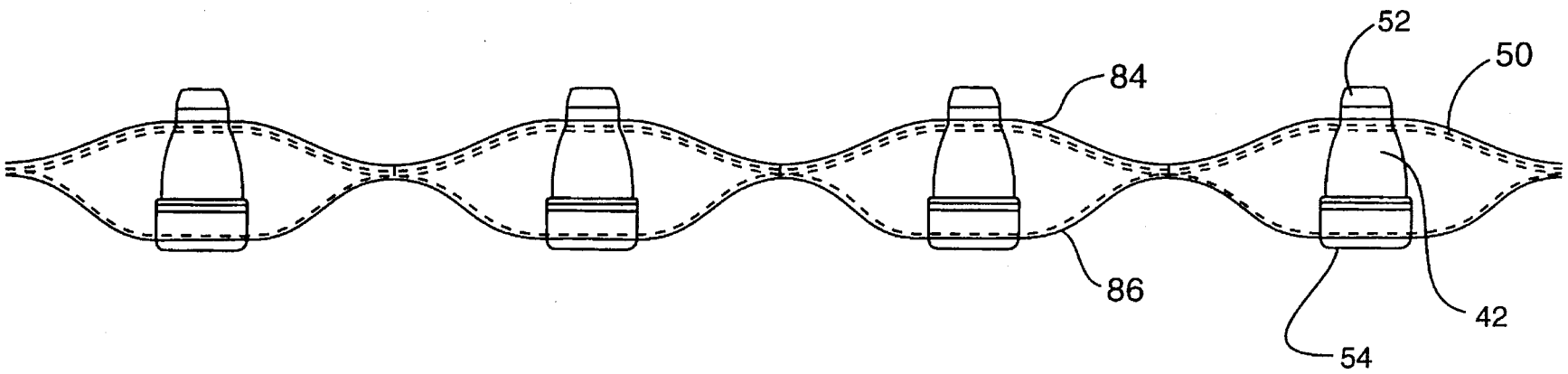
FIG. 9 is a cross-sectional view of the embodiment shown in FIG. 8.

FIG. 8 illustrates an alternative embodiment of the present invention, wherein munition assemblies 42 are suspended between upper sheet 84 and lower sheet 86. Upper sheet 84 and lower sheet 86 may be made of a rip-stop nylon material, mylar or other high performance film, or other material depending upon the intended method of deployment and environment of use. FIG. 9 shows a cross section of the embodiment illustrated in FIG. 8. It can be seen that the top end of munition assembly 42 is coupled to top sheet 84 by top cap 52, and the bottom end of munition assembly 42 is coupled to bottom sheet 86 by bottom cap 54. Detonation cord 50 is routed and coupled to the upper end of each munition assembly 42, and also retained in place by the cooperation of munition assembly 42 and top cap 52. Upper sheet 84 and lower sheet 86 are coupled together in the spaces between munition assemblies 42 by stitching 90, rivets, grommets, adhesive or thermal bonding or other means to form substantially joined areas 88. This structure forms a triangulated spacing and orientation control structure which positions and orients the munition assemblies 42 with respect to one another and with respect to the ground to achieve optimum mine neutralization rates. Upper sheet 84 and lower sheet 86 may also be joined between munition assemblies 42 by adhesive or other methods. If desired, portions of joined areas 88 may be cut out to permit air or water to flow through the explosive array, or to lighten the structure.

Upper sheet 84 and lower sheet 86 may comprise a relatively light weight flexible material such as rip stop nylon, or alternatively they may comprise a stiffer, more rigid material such as thermoplastic sheeting. The detonation cord 50 may comprise an independent cord that is routed between upper sheet 84 and lower sheet 86, or it may comprise a pyrotechnic or electrical material that is laminated or otherwise adhered to the inside surface of upper sheet 84.

The embodiment shown in FIG. 8 is thought to be particularly well suited to deployment methods involving pulling the explosive array over a minefield with hardened tractors or bull dozers.

The embodiment illustrated in FIG. 8 shows the munition assemblies 42 arranged in a generally squared grid pattern. Alternatively, the munition assemblies 42 may be arranged in a triangular, hexagonal, or other desired pattern. The embodiment of FIG. 9 is particularly well suited for pulling over ground having obstructions located thereon, as it has less of a tendency to snag and is easier to pull over obstructions than is the open weave embodiment shown in FIG. 2.

Figure 10:
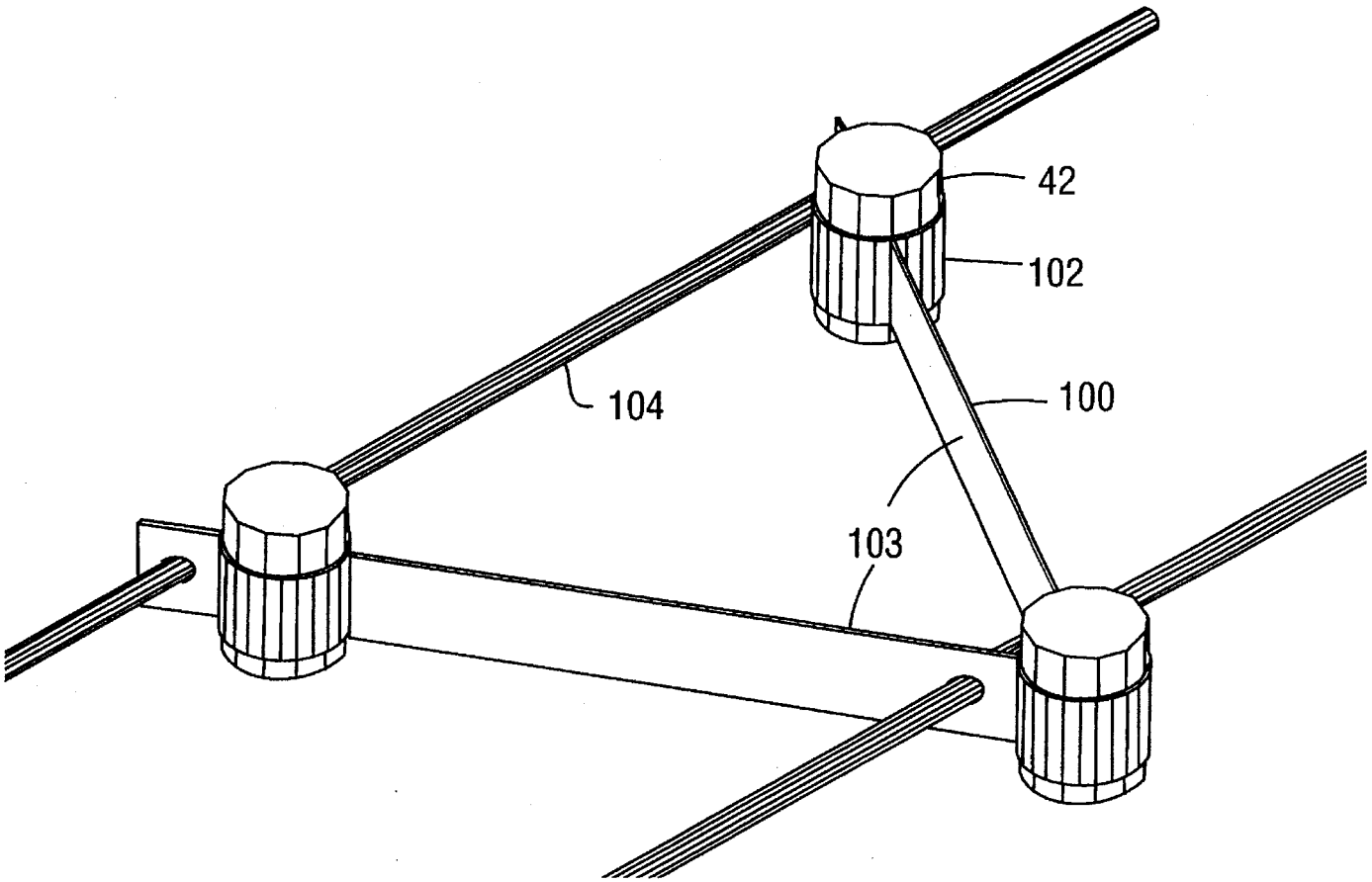
FIG. 10 is a perspective view of an alternative embodiment using a V-spreader orientation control structure.
Figure 11:
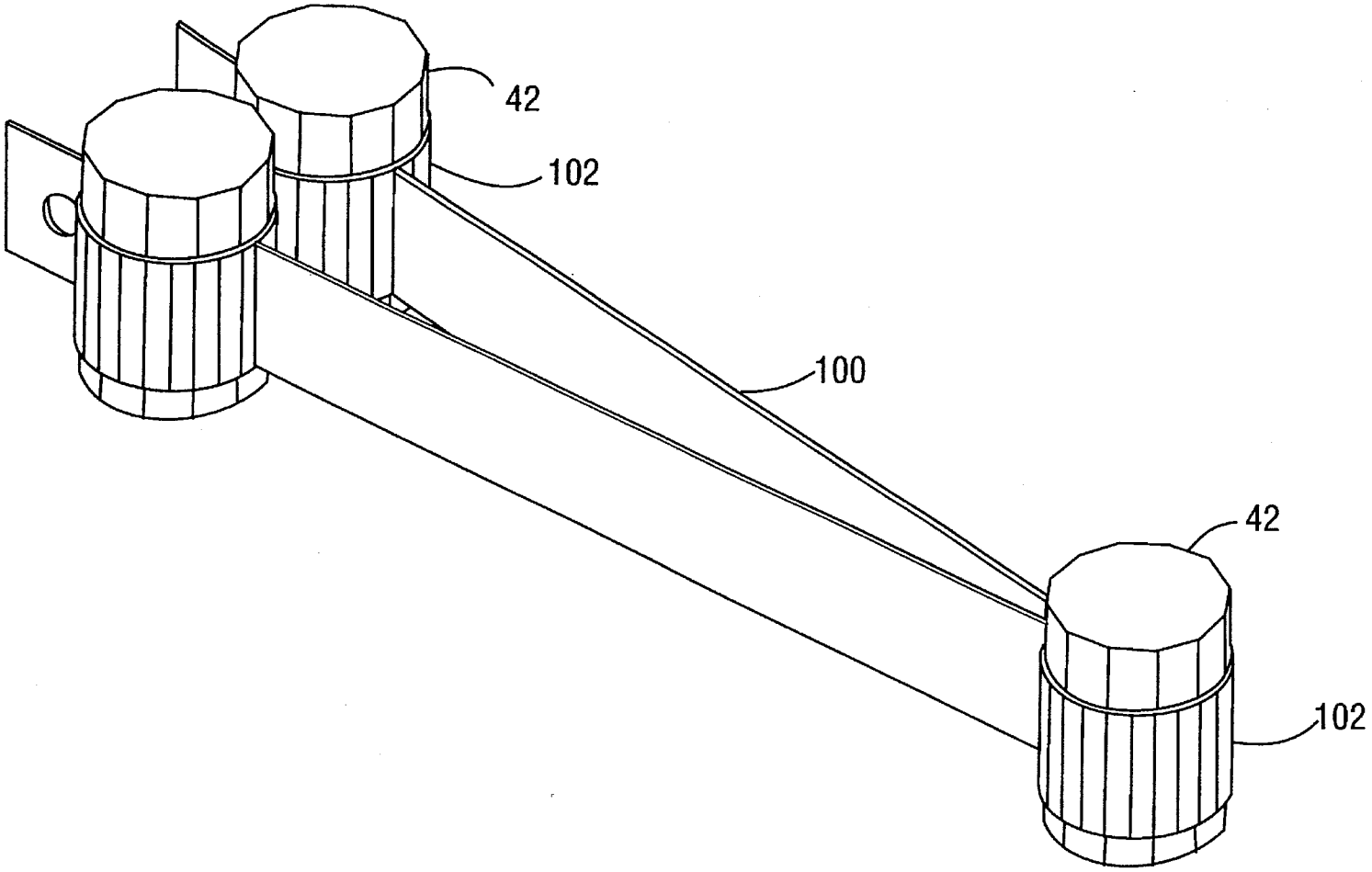
FIG. 11 a perspective view of the alternative embodiment using a V-spreader orientation control structure shown in FIG. 10, illustrated in its folded or collapsed configuration.

Another alternative embodiment of a spacing and orientation control system is illustrated in FIG. 10. This "V" spreader type of system is intended to be carried by a rope net having longitudinal ropes 104 and lateral ropes not shown. "V" spreader 100 comprises three munition sleeves 102 connected by two legs 103 as illustrated in FIG. 11. "v" spreader 100 is coupled to longitudinal net rope 104, for example, by passing longitudinal net rope 104 through orifices formed in the spreader 100 structure as shown. Penetrating munition assemblies 42 may be inserted into munition sleeves 102. Other types of attachments for connecting the objects such as munitions, to the orientation control elements may be employed. Such attachments must provide adequate strength and rigidity to retain the munitions in the proper orientation with respect to the system elements during the deployment procedure.

Referring to FIG. 11, during transport and storage prior to deployment, "V" spreader 100 may be collapsed as shown. "V" spreader 100 may be manufactured from a material having a spring or memory effect such that after releasing it from its stored collapsed configuration is resumes the spread configuration shown in FIG. 10.

Figure 12:
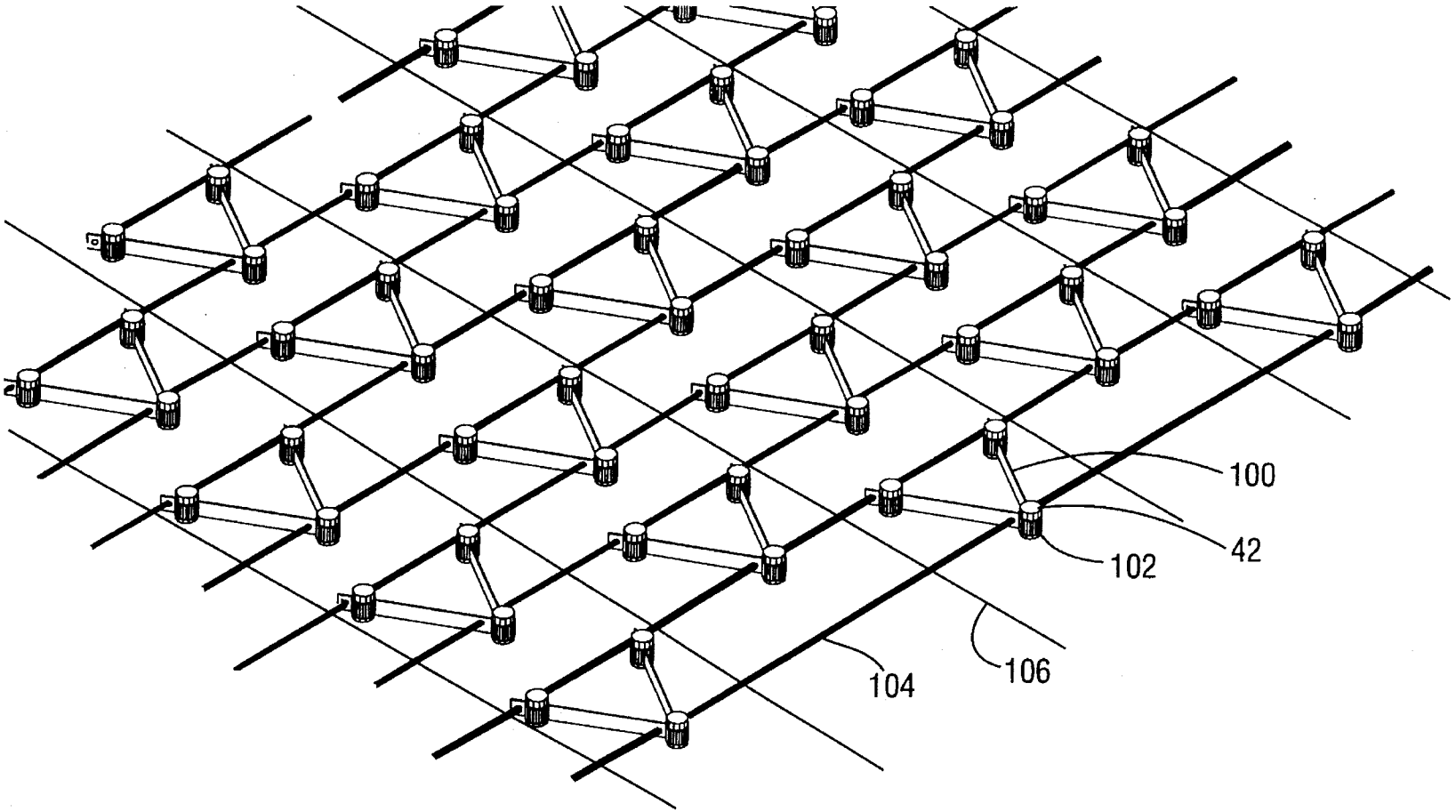
FIG. 12 is a perspective view of an array of V-spreader orientation control structures suspended on a rope net.
Figure 13:
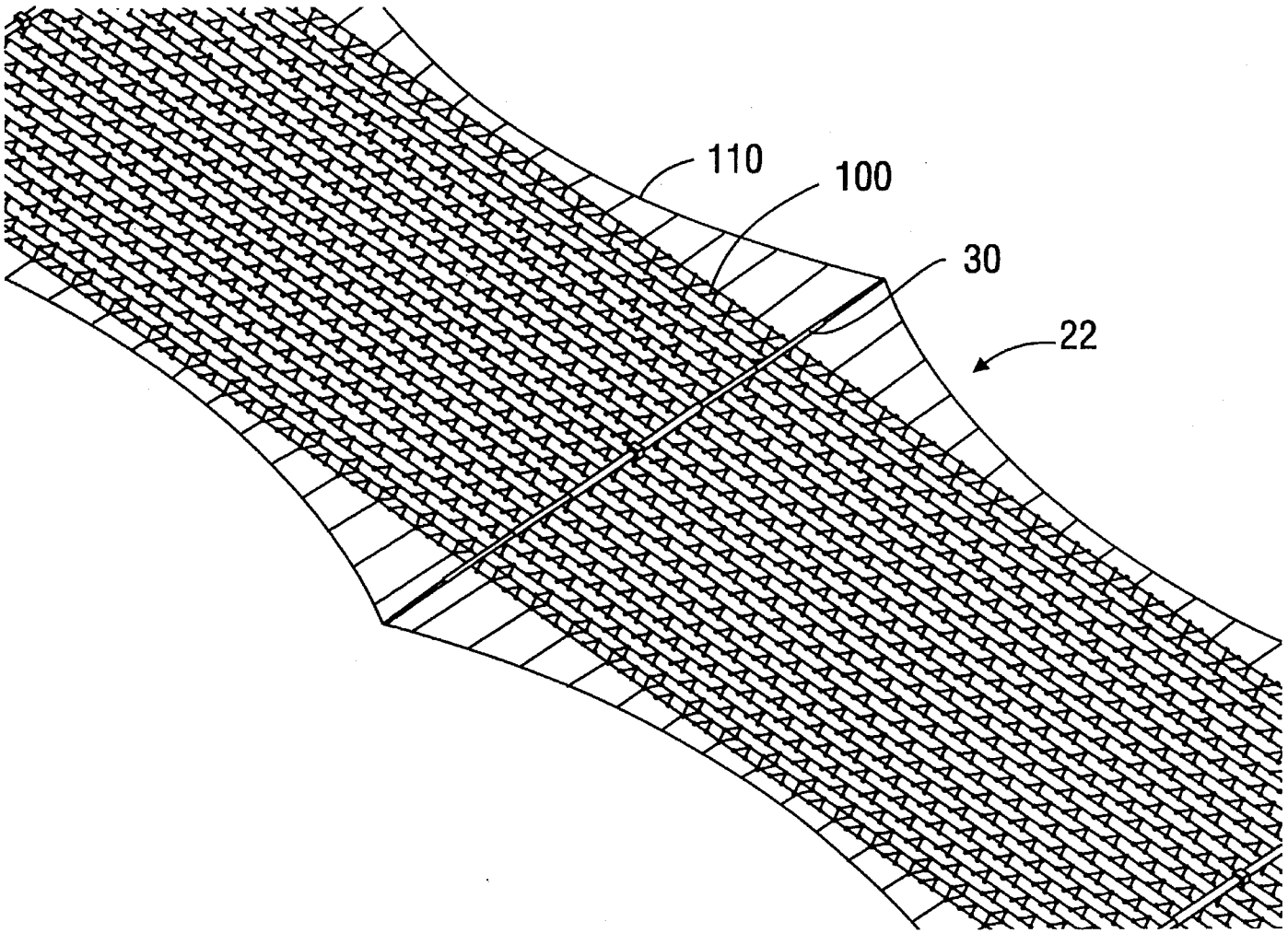
FIG. 13 is another perspective view of a larger portion of an array of V-spreader orientation control structures suspended on a rope net, showing structures that operated to laterally expand the munition array.

FIG. 12 shows a plurality of "V" spreader orientation and spacing control structures mounted on a rope net. When the rope net, comprising longitudinal ropes 104 and lateral ropes 106, is spread over a minefield by methods discussed previously, each "V" spreader structure tends to lay flat on the ground where it falls, thus properly orienting and spacing the munitions 42 carried thereby. Panels of munitions as shown in FIG. 2 could also be conveyed by a rope structure as shown in FIG. 12, with each panel suspended by or between the net ropes. FIG. 13 illustrates a larger portion of an explosive array 22 using "V" spreader spacing and orientation control devices as shown in FIG. 10. FIG. 13 illustrates the use of a lateral expansion device 30 to stretch out array 22 laterally during deployment. Catenary extension lines 110 may be provided along the lateral edges of array 22 to impose laterally outward stresses on the portions of the array between expansion devices 30.

A modification of the "V" spreader of FIG. 10 is shown in

Figure 14:
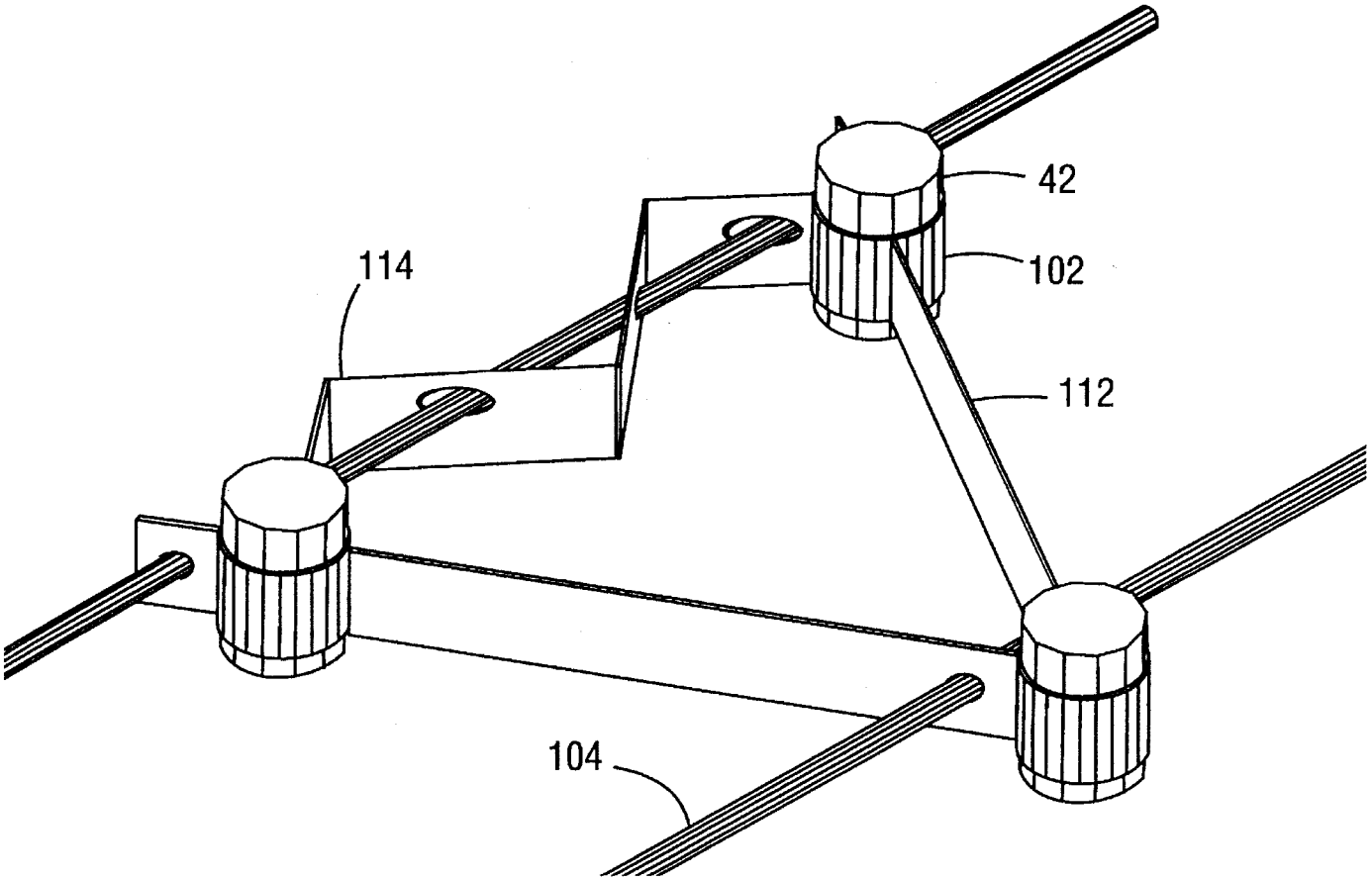
FIG. 14 is a perspective view of an alternative embodiment using a delta-spreader orientation control structure.

FIG. 14. Delta spreader 112 has a similar structure to that of "V" spreader 100, except that an accordion leg 114 is added to connect the open ends of the "V" structure, thereby providing additional stabilization. Accordion leg 114 is designed to be compressed during storage and transport of the array 22 and to expand to its expanded length during deployment of array 22.

Figure 15:
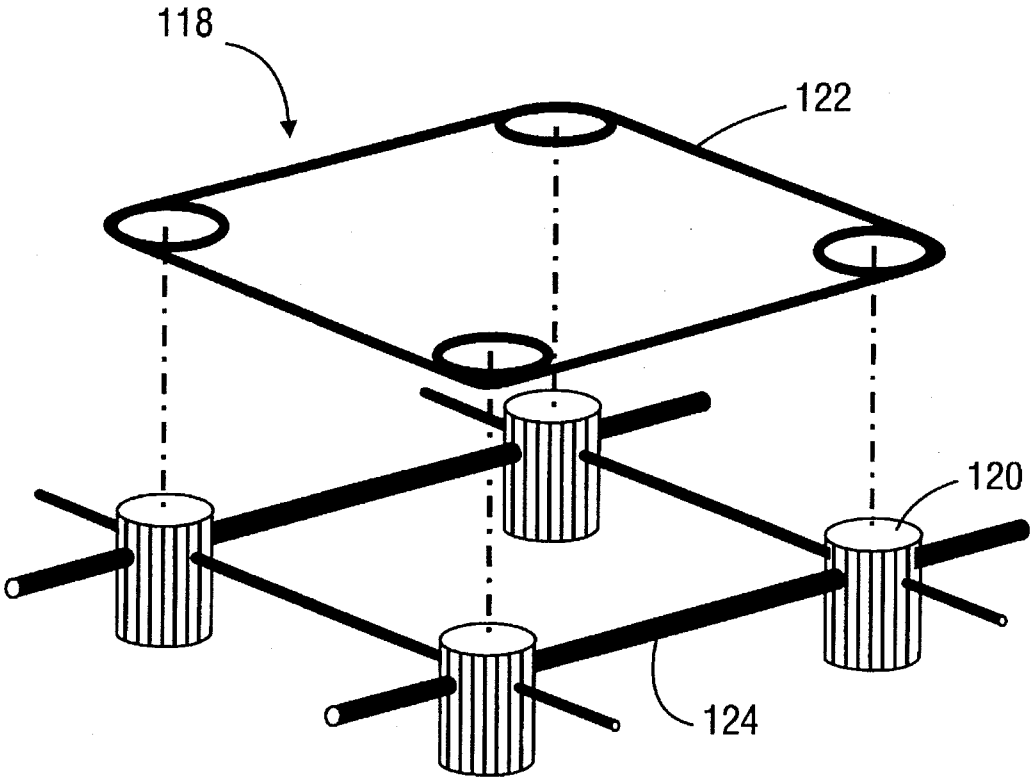
FIG. 15 illustrates a small interconnecting group approach to an orientation and spacing control system for supporting an array of munitions or other objects.

FIG. 15 shows yet another alternative embodiment of the present invention, which employs small interconnecting groups (SIG) 118 to provide spacing and orientation control to munitions or other small articles. Each SIG 118 comprises three or more objects 120, which may be anti-mine munitions, connected to one another by a rigid interconnecting frame 122. Interconnecting frame 122 is coupled to the objects 120 such that they are securely oriented normal to the plane of interconnecting frame 122, or at such other angle as may be desired. A plurality of SIGs 118 may be suspended on a net rope structure 124 as is known in the art. When deployed, each SIG 118 will tend to lay flat on the surface on which it is placed, and the frame 122 will maintain the munitions or other objects 120 in the desired orientation relative to the plane of the SIG. The frame 122 may be constructed from metal, plastic, or other materials known in the art. Each SIG 118 may be connected to the surrounding SIGs by flexible rope members, thereby isolating the SIGs from obstacles that may interfere with the orientation of neighboring SIGs, and preventing the array of SIGs from buckling and losing orientation control if the array is not fully expanded during deployment.

Figure 16A:
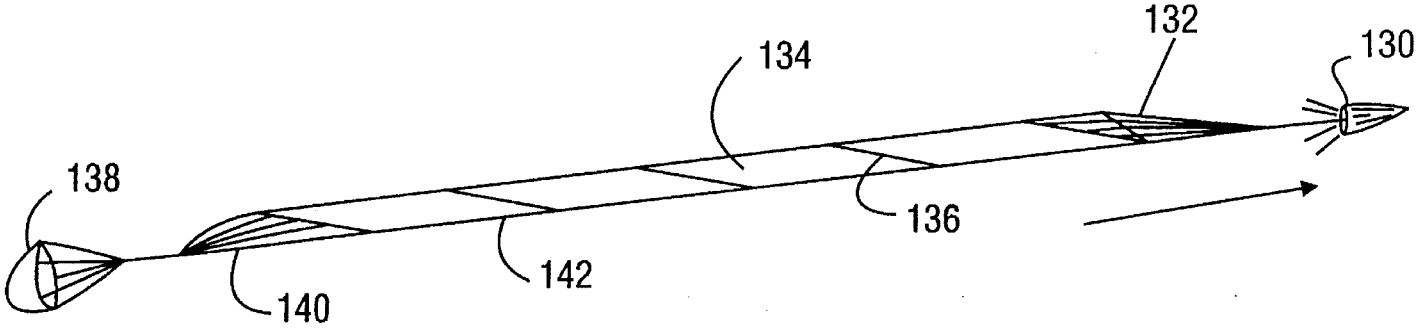
FIG. 16A and FIG. 16B illustrate an alternative deployment technique that employs a dihedral configuration to provide a stable aerodynamical shape to the munition array.
Figure 16B:
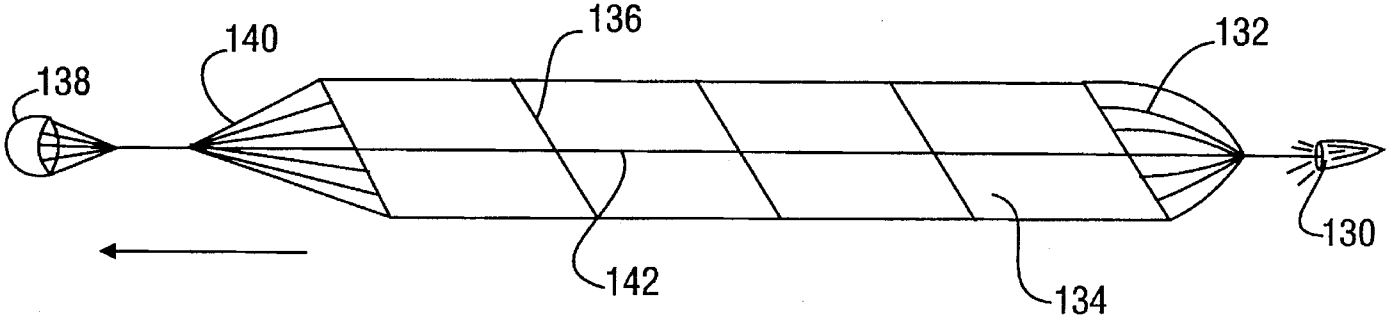

FIG. 16A and FIG. 16B show an alternative deployment system that may be utilized with the integrated spacing and orientation control system according to the present invention. This deployment system configures the munition array as a dihedral for low drag, stable flight during the powered flight phase of the deployment sequence. After rocket burnout (coasting phase), the inertia of the system combined with arresting forces produced by the drag chute (or tether) cause the array to achieve a planar configuration at its fully extended width before it lands on the ground. This deployment system can be used for over-the-horizon deployment of an array of mine clearing munitions or other objects.

During the powered flight phase, shown in FIG. 16A, rocket motor 130 pulls the array 134 and associated equipment out of a storage and transport container (not shown). The array is coupled to a plurality of lateral expansion devices 136, which comprise pairs of beams extending from the centerline 142 of the array to the lateral edges of the array, hinged at the centerline of the array. Lateral expansion devices 136 may be designed to elongate after launch of the system. The tow bridle 132 connects the array 134 to the rocket motor 130. The tow bridle is designed to tow the array in a dihedral arrangement, with the hinged lateral expansion devices forming obtuse angles during flight, the ends of each lateral expansion device being "swept back" during the powered flight phase. This is accomplished by making the outer lines of the tow bridle 132 longer than would be required to straighten the lateral expansion devices 136, combined with properly attaching the lateral expansion devices 136 to the array 134.

When the rocket motor 130 burns out, the tow bridle 132 goes slack and a decelerating force is applied by the drag chute 138 through the arrest bridle 140. The arrest bridle 140 is configured to cause the hinged lateral expansion devices 136 to straighten out as shown in FIG. 16B. In particular, during the coasting or inertial phase of the deployment flight, the center-most line of the arrest bridle 140 tightens before the outer lines, causing the outer ends of the lateral expansion devices to move forward relative to the centerline 142 of the array 134 such that each pair of lateral expansion devices 136 forms a substantially straight line across the array, causing the array to expand and flatten. The hinges of the lateral expansion devices 136 may be designed to lock into position when they straighten during this phase to ensure that the array maintains its fully expanded configuration during landing.

This invention provides a spacing and orientation control structure that comprises a plurality of penetrating munitions disposed within a structure that is operative to retain said munitions in a vertical position at a predetermined lateral spacing. Alternative embodiments of the present invention will be apparent to those of skill in the art after having the benefit of the description of the invention provided herein. The invention is not intended to be limited to the specific structures disclosed in this patent. For example, the spacing and orientation control system described and claimed herein may be suitable for carrying objects other than anti-mine munitions. This system would be suitable for use in deploying other objects that are intended to have a particular orientation with respect to the horizontal plane, or that are intended to have a particular spacing with respect to one another.

An integrated spacing and orientation control system as described herein may also be useful in space applications, for example to support antenna elements, lights, or other articles that are desired to be supported with predetermined spacing and orientation. The embodiment illustrated in FIG. 2 may be particularly well suited for such applications due to its tendency to "self-deploy," or to attain its expanded and planar configuration when released from the confines of a storage container in a zero gravity environment.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. In particular, this invention is not to be construed as limited to mine clearing applications, although that is a presently preferred application for the invention. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A remotely deployable munition array for destroying mines in a minefield, comprising:

an array of jet-type munitions each having a top end and a bottom end, each munition being designed to fire an explosive jet from its bottom end when detonated;

a generally planar network of upper flexible strapping members connected to the top ends of the munitions; and a generally planar network of lower flexible strapping members connected to the bottom ends of the munitions;

the upper strapping members being fastened to the lower strapping members at locations between the munitions.

2. The array of claim 1, wherein the munitions are arrayed in a generally square pattern.

3. The array of claim 1, wherein the munitions are arrayed in a generally triangular pattern.

4. The array of claim 1, further comprising detonating cord operatively coupled to each of the munitions in the array.

5. The array of claim 1, wherein the strapping members comprise plastic ribbon.

6. The array of claim 1, further comprising detonating conductors integrally formed with the top strapping member.

7. The array of claim 1, wherein the strapping members comprise tubular braided sheathing.

8. An integrated spacing and orientation control system for supporting an array of objects in a preselected arrangement and orientation, each object having a top and a bottom, the control system comprising:

objects, said objects further defined as munitions:

upper means for interconnecting the tops of the objects so as to restrict lateral movement of said tops;

lower means for interconnecting the bottoms of the objects so as to restrict lateral movement of said bottoms;

the upper means and lower means being joined to one another at spaced locations between the objects.

9. The system of claim 8, wherein the upper means and the lower means comprise flexible sheeting.

10. The system of claim 8, wherein the upper means and the lower means comprise flexible strapping.

11. A remotely deployable munition array for destroying mines comprising:

an array of jet-type munitions disposed in a preselected pattern and having preselected spacing and orientation for deployment over a mine field; and means for supporting the munitions during transport and deployment such that the preselected spacing and orientation of the munitions is attained after deployment;

wherein the supporting means is coupled to a top end of each munition and to a bottom end of each munition so as to control the orientation of the munitions.

12. The array of claim 11, wherein the supporting means comprises means for distributing detonating energy to each munition.

13. The remotely deployable munition array of claim 11, wherein the supporting means comprises detonating cord.

* * * * *